United States Patent [19]

Heim

[11] Patent Number: 4,943,175

[45] Date of Patent: Jul. 24, 1990

[54] FEED MECHANISM FOR A WRITING DEVICE

[75] Inventor: Otto Heim, Weigendorf, Fed. Rep. of Germany

[73] Assignee: A.W. Faber-Castell GmbH & Co., Stein, Fed. Rep. of Germany

[21] Appl. No.: 75,032

[22] Filed: Jul. 17, 1987

[30] Foreign Application Priority Data

Jul. 17, 1986 [DE] Fed. Rep. of Germany ..... 3624152

[51] Int. Cl.[5] ..... B43K 24/08

[52] U.S. Cl. ..... 401/111; 401/112

[58] Field of Search ..... 401/110, 111, 109, 112

[56] References Cited

U.S. PATENT DOCUMENTS 2,622,561 12/1952 Baker ..... 401/110
3,084,670 4/1963 Dottlinger ..... 401/111
3,084,671 4/1963 Dottlinger ..... 401/111

FOREIGN PATENT DOCUMENTS 678299 12/1964 Italy ..... 401/110
785249 10/1957 United Kingdom ..... 401/109

*Primary Examiner*—Richard J. Johnson
*Attorney, Agent, or Firm*—Michael J. Striker

[57] ABSTRACT

A feed mechanism for a writing device comprising a writing medium carrier which is displaceable in a housing in a front and rear position by means of a press button. Connected with the press button is a rotatable switching element which comprises a circulating switching cam in which a carrier element engages. A spring is arranged between the carrier element and a locking element, and the locking element comprises a spring arm with a supporting surface which engages in an opposed surface at the housing.

7 Claims, 3 Drawing Sheets

Figure 1:
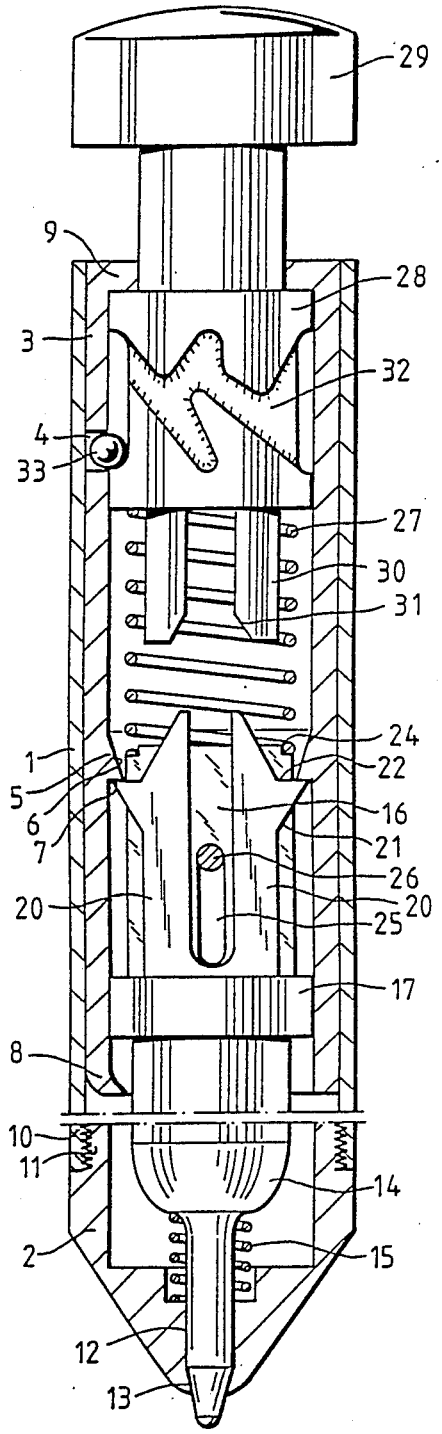

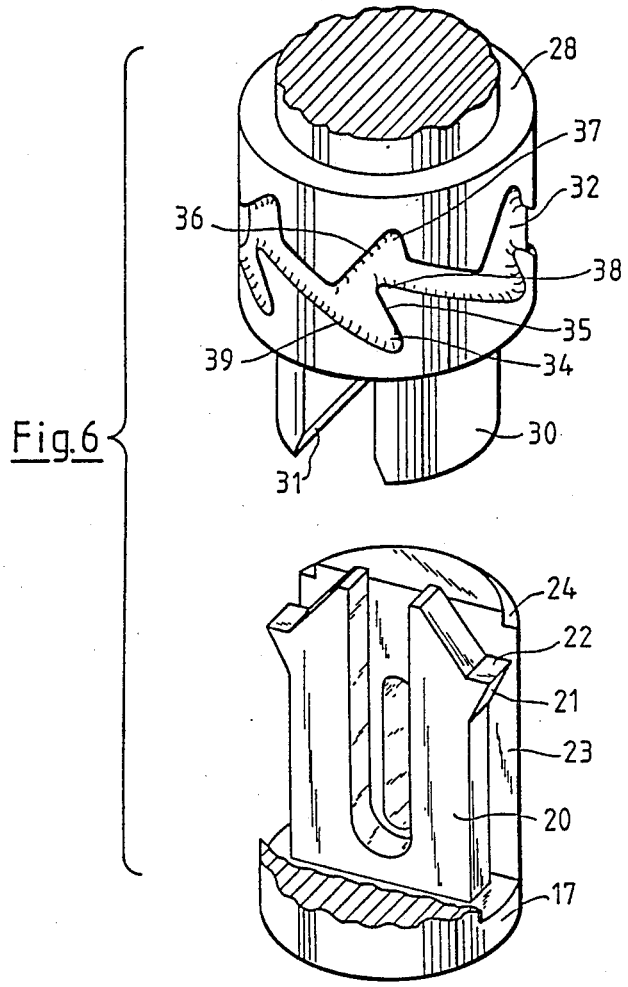
Fig.6
Fig.7
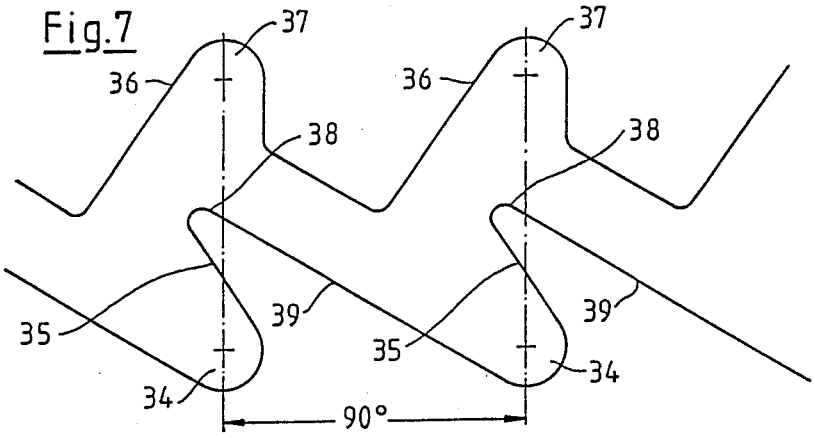

FEED MECHANISM FOR A WRITING DEVICE

The invention is directed to a feed mechanism for a writing device comprising a writing medium carrier which is fixable in a front and rear position in a housing and is influenced by the action of a return spring, wherein an axially movable locking element is arranged between the writing medium carrier and a press button, which latter projects from the housing at the rear end.

A plurality of different constructions of such feed mechanisms for writing medium carriers are already known. However, only two types, which are used for writing devices in different price categories, have been successful in the practice of large-scale production.

The most commonly used type of feed mechanism can be seen, for example, from the DE-PS No. 1 561 789. The lead, which is supported in the shaft so as to be displaceable, is actuated by means of a press button which projects out of the shaft. The press button comprises switching elements which are guided between strips in the interior of the shaft so as to be axially movable. The switching elements consist of projections which are beveled at the front side. A rotatable switching member, which likewise carries beveled projections, contacts this front side. When the press button is actuated, the two elements are moved axially toward the tip of the writing device and, in so doing, are guided between the strips arranged inside the shaft. As soon as the rotatable switching member protrudes from the strips, the bevels cause a rotational movement which is defined by means of a notch in which the strip catches. In order to unlock the switching member, the press button must be actuated again, wherein a distance must be overcome which must correspond to at least the depth of the notch in order to lift the latter from the strip. The depth of the notch accordingly determines the so-called excess lift necessary, in addition to the switching distance, for advancing the writing medium carrier. In order to trigger the switching process the press button must be pressed relatively far, since the excess lift must be overcome in addition to the actual lift for advancing the lead. This is not only disadvantageous for the user, but also results in a less pleasant external appearance of the writing device, since the press button must project very far out of the writing device shaft.

Whereas the feed mechanisms with rotatable switching member are widely used in writing devices in the lower price category because of their low cost, the more expensive products use mechanisms in which a ball rolls in a switching cam. This type of feed mechanism has the advantage that the switching process progresses easily and noiselessly and offers the user a pleasant feel. However, this type of feed mechanism also has the disadvantage that both a lift and an excess lift are necessary in order to lock the writing medium carrier. The principle of a feed mechanism with switching cam and ball or guide pin can be seen, for example, from DE-OS No. 2 423 169. It can clearly be seen from the construction of the cam that the lead which is locked in the writing position must be advanced a considerable distance in order to effect a deflection of the locking part. This process of deflection results in a considerable excess lift which has disadvantageous consequences as in the mechanisms with rotatable switching member. The entire switching distance becomes relatively long and the result of this is also that the press button of the writing device must project very far out of the shaft.

In addition, a writing device is known (DE-PS No. 2 125 782) in which the movement of the press button is augmented by means of a step-up gearing. In addition, a tappet, which is movable relative to the press button by means of a gear wheel, is provided in an axial borehole of the press button. Besides the additional expenditure required by the step-up gearing, it is also a problem to accommodate these parts within the small space available on the press button.

In contrast, the present application has the object of decreasing the switching distance for actuating the feed mechanism. With the use of simple structural component parts and with a low space requirement, a mechanism is to be provided which gives the user a pleasant switching feel and only slightly restricts the possibilities for the construction of the press button.

This object is met in a feed mechanism according to the generic type by means of the characterizing features of claim 1. The advantages achieved with the invention consist particularly in that neither an excess lift during actuation of the press button, nor an excessive switching pressure for actuating a step-up gearing need be overcome in order to advance and retract the writing medium carrier. Only a slight play between the two catch members is necessary for the catching of the supporting surface at the spring arm of the locking element, which play does not make itself visibly noticeable on the outwardly projecting portion of the press button, since there is no excess lift.

According to an advantageous construction of the invention, the switching fork is constructed in the front position of the locking element so as to be displaceable in the swiveling area of the spring arms, whereas, in the rear position of the locking element, the switching fork is supported on the pressing columns. In this way, no excess lift is required during the actuation of the press button for unlocking the locking element, since the spring arm exclusively executes a movement perpendicular to the center axis of the writing device, which movement is triggered by the axial movement of the switching element.

A particularly reliable switching operation of the feed mechanism is achieved if the pressure spring, which rests directly on the switching element, is first pretensioned for torsion during the feed movement and reinforces the continued rotation of the switching element when released. In addition, it is advantageous to form the connection of the catch depression to the reversing or deflecting depression, which forms a portion of the switching cam, by means of pretensioning and releasing paths and arranging the catch and reversing depression on a straight line which extends parallel to the center axis of the writing device.

Since no excess lift is required in the feed mechanism for locking the advanced writing medium carrier, the writing tip can be centered by means of an advantageous construction of the lead outlet borehole This has the advantage that the user notices no play between the front part and the writing tip. This advantage is achieved by means of a writing medium carrier which projects out of the borehole in the front position and rests with its conical writing tip against a reduced portion, the rear end being supported at the locking element.

In order to accommodate the occurring tolerances in length of the writing medium carrier, another construction of the pocket for receiving the lead is provided at the locking element. For this purpose, the rear end of the writing medium carrier rests on a resilient disk which is fixed in a pocket in the locking element. Accordingly, when the lead rests at the reduced portion, the tolerances in length can be accommodated by the resilient disk.

According to another construction of the feed mechanism, the carrier ball can be inserted in the switching cam in a particularly smooth manner. For this purpose, the carrier ball is supported in a ball pocket which is constructed as an opening in the guide bushing which is covered outwardly by means of a housing.

Moreover, it is advantageous to construct the entire feed mechanism as a structural unit which can be preassembled outside the housing. The feed mechanism can accordingly be used as a unit in various embodiment forms of writing devices; i.e. one need only support a structural unit on bearings, which structural unit is suitable for various embodiment forms of writing devices. In addition, the functional parts comprising the locking unit, switching element and pressure spring are supported in the guide bushing so as to be fixed in a stationary manner by means of a torus and a transverse pin so as to form a structural unit which is insertable in the housing.

Figure 2:
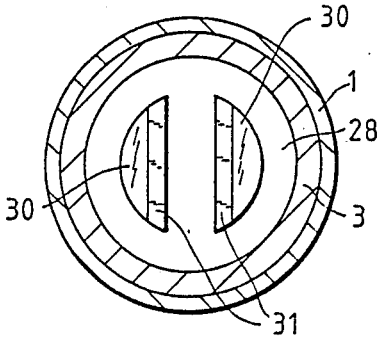
Figure 3:
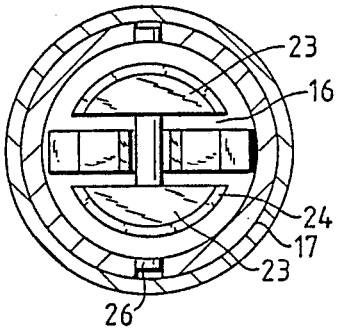
Figure 4:
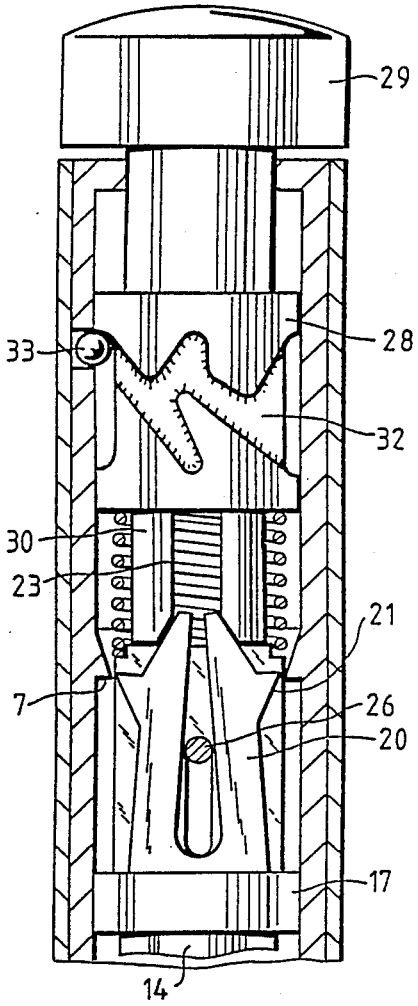
Figure 5:
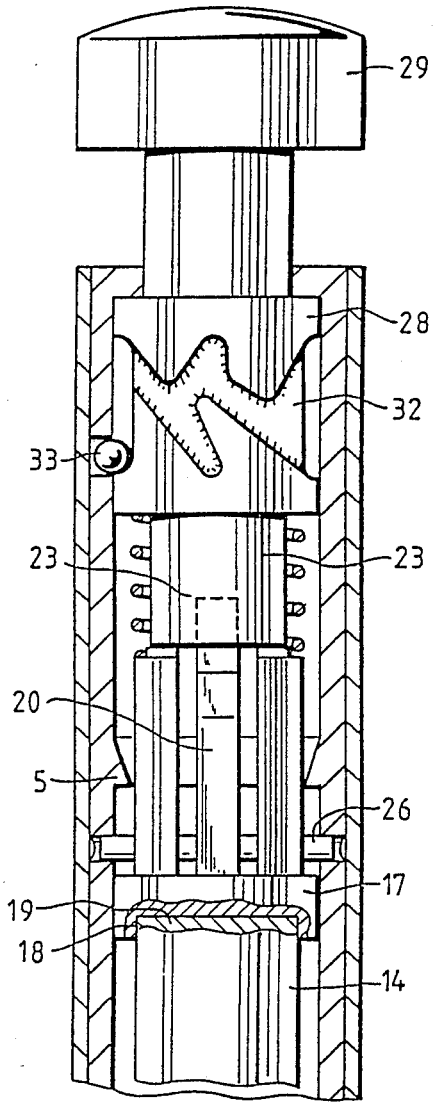

An embodiment example of the invention is shown in the drawings and described in the following:

FIG. 1 shows a longitudinal section through the feed mechanism which is inserted in a writing device, the writing medium carrier is advanced, FIG. 2 shows a cross section through the switching element, FIG. 3 shows a cross section with a top view of the locking element, FIG. 4 shows the feed device with unlocked locking element, FIG. 5 shows the feed device in longitudinal section with retracted writing medium carrier, FIG. 6 shows the switching element and the locking element in a perspective presentation and FIG. 7 shows a developed view of the switching cam.

The writing device, according to the invention, consists, in a conventional manner, of a housing 1 which is connected with a front part 2. A guide bushing 3 is supported at the rear end in the housing 1 and comprises a ball pocket 4 and a support collar 5, which is formed by means of a guide bevel 6 and a supporting surface 7 and projects into the inner diameter of the guide bushing 3, a projection 8 being formed on at the lower end of the latter. A torus 9 is formed on at the rear end face of the guide bushing 3.

The housing 1 comprises an internal thread 10 in which an external thread 11 of the front part 2 is screwed. The front part 2 contains a borehole 12 which passes into a reduced portion 13, the tip of a writing medium carrier 14 lying adjacent to the latter. A spring 15, with which the writing medium carrier 14 is pressed against a locking element 16, is tensioned between the front part 2 and the writing medium carrier 14 in a conventional manner. The locking element 16 is guided in the guide bushing 3 by means of a cylinder 17 and comprises a pocket 18 in which a resilient disk 19 is inserted. At least one spring arm 20, which comprises a stop bevel 21 and a supporting surface 22, is formed on at the locking element 16. Moreover, the locking element 16 carries at least one pressing column 23 which serves additionally as a spring support 24 and contains an elongated hole 25 in which a transverse pin 26 engages, the latter being supported in the guide bushing 3. A pressure spring 27, which, in FIG. 1, presses the locking element 16 downward against the transverse pin 26 and presses the switching element 28 upward against the torus 9, is inserted between the locking element 16 and a switching element 28. A press button 29, which can be shaped as desired, is connected with the switching element 28. Thus, for example, it is possible to construct this press button 29 in a mushroom-shaped manner without a great distance occurring between the housing and the lower edge of the mushroom. Accordingly, no narrow limits are imposed on the constructional freedom of the external appearance.

Opposite the press button 29, the switching element 28 carries a switching fork 30, beveled surfaces 31 being arranged at its inner sides. A switching cam 32 is formed in at the outer circumference of the switching element 28, a carrier ball 33, which is supported in the ball pocket 4 of the guide bushing so as to be stationary but rotatable, engages in the switching cam 32.

FIG. 7 shows a developed view of the switching cam 32. The carrier ball 33 lies in the initial position of the switching element 28 in a catch depression 34 adjoined by a pretensioning path 35. The switching cam 32 is continued by the pretensioning path 35 to a so-called releasing path 36 which terminates in a reversing depression 37. Projecting between the latter is a control projection 38, which simultaneously forms the start of a rotation path 39 which terminates in the next catch depression 34. The distance from one catch depression 34 to the next is distributed along the circumference of the switching element 28 by 90° in each instance—four times along the circumference.

The operation of the feed mechanism is easy to understand when one follows the course of movement of the switching element 28 and the locking element 16. Proceeding from the position according to FIG. 1, in which the writing medium carrier 14 is ready to write, the press button 29 can be moved into the housing 1. In so doing, the switching element 28 is guided in the axial and radial direction by means of the carrier ball 33. The course of movement can be seen from FIG. 7. When the press button 29 is actuated the switching element 28 only executes the movement permitted by the carrier ball 33. For this reason, the switching element 28 is first rotated out of the catch depression 34 in the counterclockwise direction, since the carrier ball 33 glides along the pretensioning path 35. During this movement, the pressure spring 27 is first slightly pretensioned for torsion in its rotating direction and, when the carrier ball 33 strikes against the releasing path 36, causes a rotation of the switching element 28 in the clockwise direction until the carrier ball 33 falls into the reversing depression 37. In this position, the press button 29 is completely pressed down and, in so doing, as shown in FIG. 4, has already pressed the spring arms 20 together enough so that the supporting surfaces 22 have parted from the opposite supporting surfaces 7. Since the ends of the switching fork 30 simultaneously rest on the pressing columns 23 in this position, the position of the locking element 16 remains unchanged. A retraction of the locking element 16 and, accordingly, of the writing medium carrier 14 can only be effected if the press button 29 is released by the user.

As the press button 29 travels back into the initial position according to FIG. 1, the carrier ball 33 enters the rotation path 39 causing the switching element 28 to be rotated 90° in the clockwise direction until the carrier ball 33 again lies in the next catch depression 34.

The switching fork 30 accordingly occupies a position shown in FIG. 5. For this reason, during the movement for advancing the writing medium carrier 14 from the retracted position into the writing position according to FIG. 1, the ends of the switching fork 30 come to rest on the pressing columns 23, wherein the spring arms 20 can spring freely and can place themselves behind the supporting surface 7 after running into the guide bevel 6. The locking element 16 is prevented from twisting relative to the guide bushing 3 during this movement by means of the transverse pin 26 which moves in the elongated hole 25. Moreover, the longitudinal movement of the locking element 16 is defined by means of the transverse pin 26 in such a way that the supporting surfaces 7 and 22 are separated from one another only to the extent that the spring arms 20 can spring into the locking position. No excess lift which is noticeable by the user at the press button 29 is necessary for this purpose.

Since the switching element 28 is rotated 90° during the return to the initial position, the switching fork 30 occupies a position which permits an unlocking of the locking element 16 according to FIG. 4.

Accordingly, the essential idea of the feed mechanism according to the invention consists in that when advancing the writing medium carrier 14 from the retracted rest position the switching element 28 is controlled in such a way that the switching fork 30 moves the locking element 16 without acting on the spring arms 20. The latter can accordingly spring freely and catch in the locking position. When the writing medium carrier 14 is advanced and the switching element 28 is retracted, the latter is again in an initial position in which the switching fork 30 is turned in such a way that the locking element 16 can be unlocked during the forward movement of the switching element 28 in order to be returned to the rest position.

In order not to allow the press button 29 to rotate along during the rotational movement of the switching element, these two parts can be constructed so as to be rotatable relative to one another.

I claim:

1. Feed mechanism for a writing device comprising a writing medium carrier which is fixable in a housing in a front and rear position and is influenced by the action of a return spring, wherein an axially and radially movable switching element and an axially movable locking element are arranged between the writing medium carrier and a press button which projects out of the housing at the rear end, characterized in that the writing medium carrier (14) rests at the locking element (16) which is supported in an elongated hole (25) by means of a transverse pin (26) so as to be fixed relative to the housing (1) with respect to rotation, but so as to be axially movable in the housing (1), comprises a pressing column (23) and a spring arm (20) with a stop bevel (21) and a supporting surface (22), which is swivelable in the area of a supporting collar (7) in the housing (1) and carries a pressure spring (27) which is supported at the switching element (28) which comprises a continuously circulating switching cam (32) at its circumference, which switching cam (32) extends substantially parallel to the central axis of the writing device from a catch depression (34) to a reversing depression (37) and passes, in each instance, into a diagonal rotation path (39); and in that a carrier ball (33), which is inserted in a ball pocket (4) so as to be rotatable and fixed in this location, engages in the switching cam (32); and in that the switching element (28) comprises the press button (29) at its rear end and carries a switching fork (30) at the opposite end.

2. Feed mechanism according to claim 1, characterized in that, in the front position of the locking element (16), the switching fork (30) is displaceable in the swiveling area of the spring arms (20, while in the rear position of the locking element (16) the switching fork (30) rests on the pressing columns (23).

3. Feed mechanism according to claim 2, characterized in that the connection of the catch depression (34) with the reversing depression (37), which forms a part of the switching cam (33), is formed by means of pretensioning and releasing paths (35; 36); and in that the catch and reversing depressions (34; 37) lie on a straight line which extends parallel to the center axis of the writing device.

4. Feed mechanism according to claim 3, characterized in that the writing medium carrier (14) projects out of the borehole (12) in the front position and rests at a reduced portion (13) with its conical writing tip, and its rear end is supported at the locking element (16).

5. Feed mechanism according to claim 4, characterized in that the rear end of the writing medium carrier (14) rests on a resilient disk (19) which is fixed in a pocket (18) in the locking element (16).

6. Feed mechanism according to claim 5, characterized in that the carrier ball (33) is supported in a ball pocket (4) which is constructed as an opening in the guide bushing (3) which is covered outwardly by a housing (1).

7. Feed mechanism according to claim 6, characterized in that the functional parts comprising the locking element (16), switching element (28) and pressure spring (27) are supported in the guide bushing (5) so as to be fixed in a stationary manner by means of a torus (9) and a transverse pin (16) and form a structural unit which is insertable in the housing (1).

* * * * *